United States Patent [19]

Artz

[11] 4,044,933

[45] * Aug. 30, 1977

[54] ARTICLE CARRIER WITH IMPROVED COMBINATION BELT LOOP AND CLIP

[75] Inventor: Kenneth W. Artz, Albuquerque, N. Mex.

[73] Assignee: Kosgegi Leather & Vinyl Products, Inc., South Bend, Ind.

[ * ] Notice: The portion of the term of this patent subsequent to Feb. 10, 1993, has been disclaimed.

[21] Appl. No.: 647,996

[22] Filed: Jan. 9, 1976

Related U.S. Application Data

[63] Continuation of Ser. No. 531,486, Dec. 11, 1974, Pat. No. 3,937,373.

[51] Int. Cl.[2] ..... A45C 11/00

[52] U.S. Cl. ..... 224/26 R

[58] Field of Search ..... 224/5 R, 5 A, 5 B, 5 C, 224/5 D, 5 G, 5 H, 5 V, 5 W, 26 R, 26 B, 26 D, 26 F, 26 G, 26 H, 26 J, 26 K, 25 R, 27, 3, 2 B, 2 C, 2 D; 24/3 J, 3 L

[56] References Cited

U.S. PATENT DOCUMENTS

| | | | |
|---|---|---|---|
| 1,388,073 | 8/1921 | Stewart | 224/5 R |
| 3,091,378 | 5/1963 | O'Dwyer | 224/26 R |
| 3,317,097 | 5/1967 | Giordano | 224/5 G |
| 3,937,373 | 2/1976 | Artz | 224/26 R |

*Primary Examiner*—Robert J. Spar
*Assistant Examiner*—Jerold M. Forsberg
*Attorney, Agent, or Firm*—Oltsch & Knoblock

[57] ABSTRACT

An article carrier having a back to which is connected a belt loop carrying a clip. The clip may be utilized as an alternative means to the belt loop for attaching the carrier to the belt or a pocket.

1 Claim, 6 Drawing Figures

Fig. 1
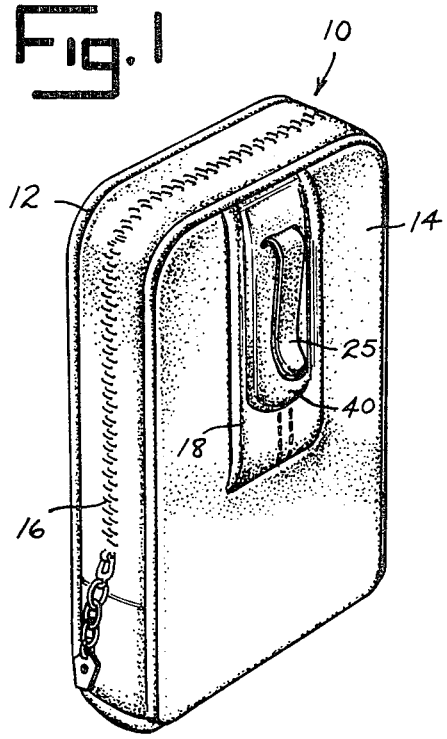
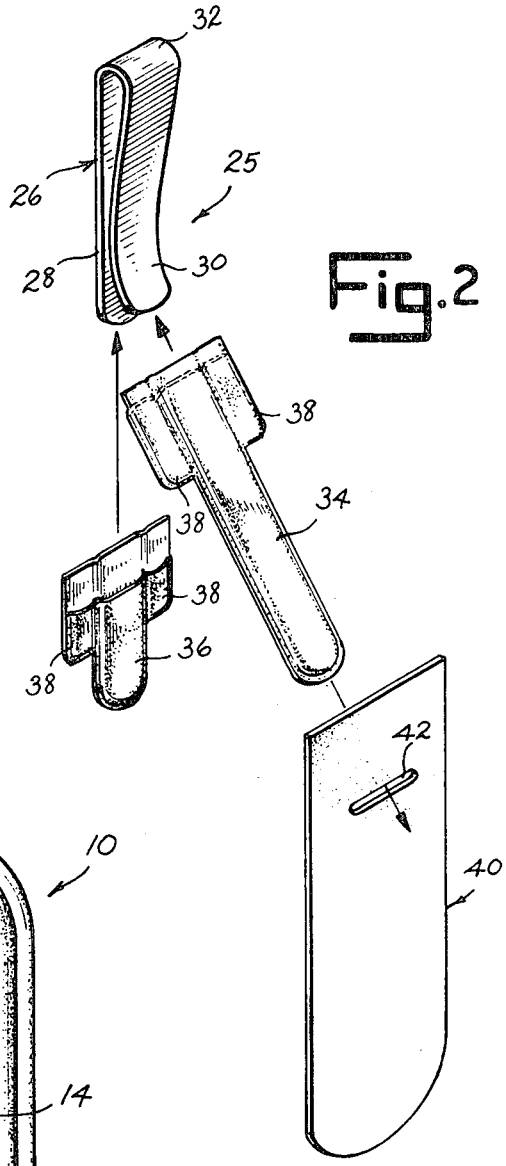
Fig. 2
Fig. 3
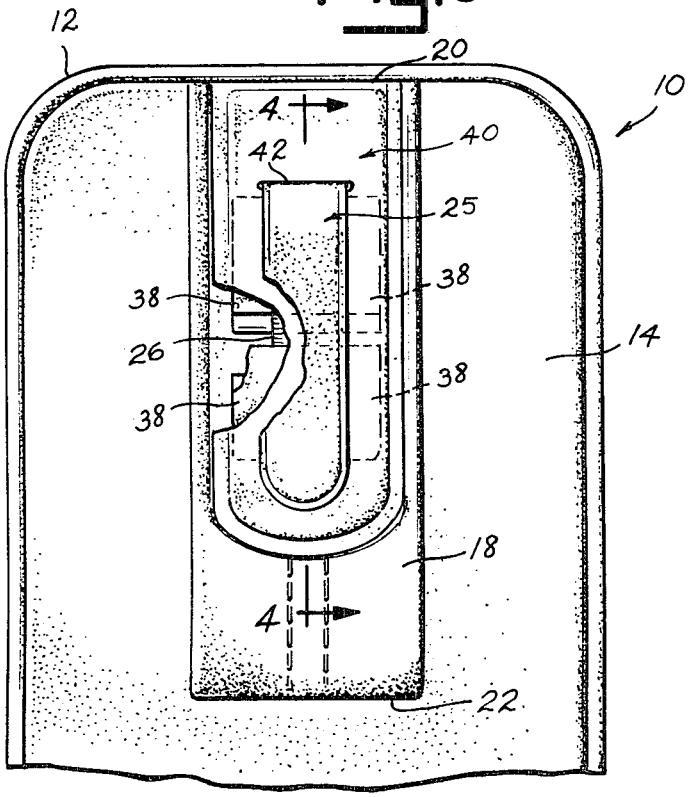

Fig. 4
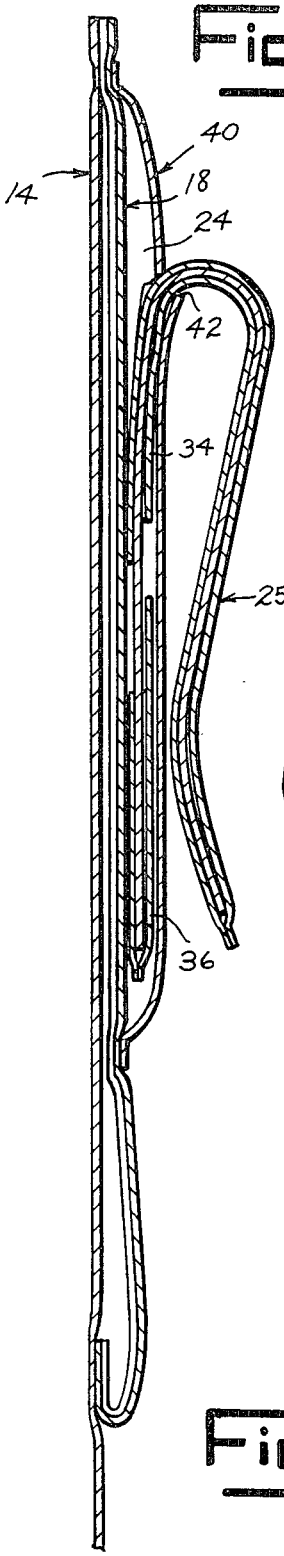
Fig. 5
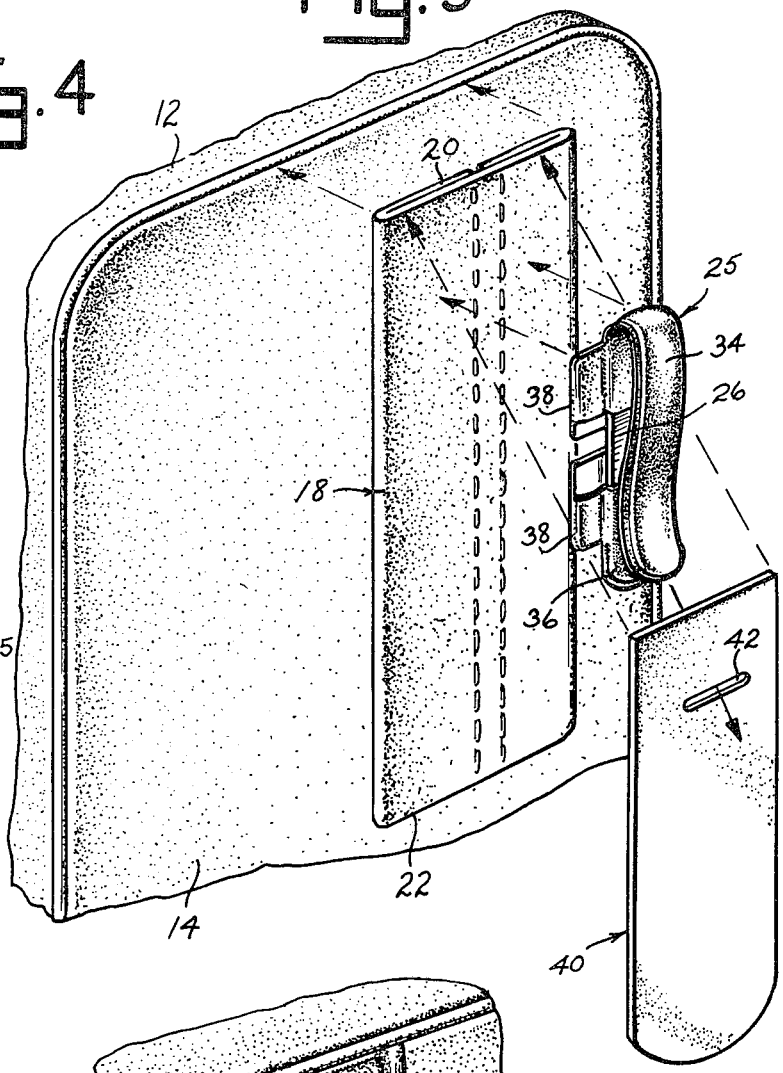
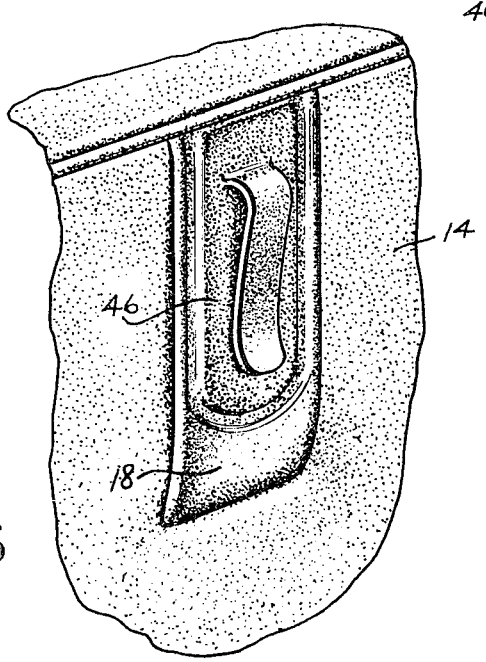
Fig. 6

ARTICLE CARRIER WITH IMPROVED COMBINATION BELT LOOP AND CLIP

CROSS REFERENCE TO A RELATED APPLICATION

This application is a continuation of application Serial No. 531,486, filed Dec. 11, 1974Now U.S. Pat. No. 3,937,373.

SUMMARY OF THE INVENTION

This invention relates to a carrier for such articles as small computers, cameras or measuring instruments, and will have specific application to an improved means for attaching the carrier to the belt or pocket.

The article includes a back having front and rear faces. A loop member is connected to the rear face of the carrier back so as to define a belt receiving passage. A clip is connected to the outer face of the loop member for the purpose of providing an optional means of attaching the article carrier to the belt, pocket or similar article of clothing of the carrier user.

It is therefore an object of this invention to provide an article carrier which includes a combination belt loop and clip for the purpose of attaching the carrier to the belt, a pocket or similar article of clothing of the carrier user.

Another object of this invention is to provide an article carrier which is attachable alternatively to either the belt or pocket of the carrier user and which is of a pleasing appearance.

Still another object of this invention is to provide an article carrier which can be attached to either the belt or pocket of the carrier user by means of a loop and clip combination and which is of economical construction.

Other objects of this invention will become apparent upon a reading of the invention's description.

BRIEF DESCRIPTION OF THE DRAWINGS

FIG. 1 is a perspective view of an article carrier which includes one embodiment of the combination loop and clip attachment means of this invention.

FIG. 2 is a perspective view showing the component parts of the loop and clip attachment means of the carrier of FIG. 1 in exploded form.

FIG. 3 is a fragmentary rear elevational view of the carrier of FIG. 1 showing portions of the loop and clip attachment means broken away for purposes of illustration.

FIG. 4 is a sectional view taken along line 4—4 of FIG. 3.

FIG. 5 is a detailed perspective view of the loop and clip attachment means of the carrier of FIG. 1 shown in exploded form.

FIG. 6 is a fragmentary perspective view of a modified construction of the loop and clip attachment means of this invention.

DESCRIPTION OF THE PREFERRED EMBODIMENTS

The preferred embodiments illustrated are not intended to be exhaustive or to limit the invention to the precise forms disclosed. They are chosen and described in order to best explain the principles of the invention and its application and practical use to thereby enable others skilled in the art to best utilize the invention.

The carrier 10 illustrated in FIGS. 1-5 includes a compartment portion 12 which may be formed into a variety of shapes to accommodate any of a variety of articles, such as small computers, cameras, hand guns, binoculars or other sighting devices and measuring instruments. The compartment portion 12 includes a back 14 as well as a front and sides. In the illustrated embodiment, compartment portion 12 is closed by means of a zipper 16.

Connected to back 14 of compartment portion 12 is the combination loop and clip attachment means of this invention. An elongated loop member 18 is secured at its upper end 20 and its lower end 22 to the rear face of compartment back 14. The means of securing the loop member at its upper and lower ends 20 and 22 to back 14 may be by way of heat sealing, stitching, or by use of an adhesive or bonding agent. The inner side of loop member 18 and the underlying portion of the rear face of compartment back 14 form an opening or passage 24 to accommodate the belt of the carrier user.

A clip 25 is carried by loop member 18 and includes an inverted U-shaped holder 26 having a pair of leg parts 28 and 30 connected by a web 32. Holder 26 is formed of a flexible material such as spring steel or plastic to enable leg parts 28 and 30 to be flexed toward and away from one another. Holder 26 is encased in a thin jacket, which in the illustrated embodiment of FIGS. 1-5 is of a two-part construction. Each of the jacket parts 34 and 36 includes oppositely extending tabs 38 which when the jacket parts are assembled onto holder 26 extend laterally outwardly from opposite sides of leg part 28 of the holder.

A cover 40 is provided to secure jacketed holder 26 to loop member 18. A horizontal slot 42 is formed near the upper edge of the cover. Jacketed holder leg part 30 is inserted through slot 42 in cover 40 and holder web 32 is located at the slot with leg part 28 being positioned at the back face of the cover. The assembly of jacket parts 34 and 36 onto holder 26 and the insertion of leg part 30 of the holder through cover slot 42 are illustrated pictorially in FIG. 2. In some constructions of this invention, the jacket about holder 26 may be of a one-piece construction.

Cover 40, with leg part 30 of holder 26 extending forwardly through its slot 42, is placed over the outer face of loop member 18 and secured about its marginal edges to the loop member by means of heat sealing, stitching or an adhesive bonding material. With cover 40 so secured to the outer face of the loop member, an envelope is formed by the cover and loop member in which leg part 28 of holder 26 is located. The transverse dimension across tabs 38 of the jacketed holder exceeds the length of slot 42 in cover 40 so that, with the tabs 38 having located within the envelope formed by the cover and loop member 18, the holder is prevented from being removed or disconnected from the carrier. Thus, holder 26 when secured to loop member 18 by cover 14 forms clip 25 which in conjunction with the loop member serve as alternative means by which carrier 10 can be attached to the belt, pocket or other article of clothing of the carrier user.

In the embodiment of the article carrier shown in FIG. 6 the holder 26 and cover 40 which were described in the previous embodiment are formed into a one-piece unitized construction identified as clip 46. Clip 46 may be formed of a flexible plastic material and is secured to the outer surface of loop member 18 by means of heat sealing, stitching or an adhesive bonding agent.

It is to be understood that the invention is not to be limited to the details above given but may be modified within the scope of the appended claims.

What is claimed is:

1. In an article carrier which includes a back having front and rear faces, the improvement comprising a loop member having upper and lower ends, said loop member having inner and outer sides, means attaching said upper and lower loop member ends to said carrier back with said loop member inner side spacedly confronting said back face to define a belt receiving passage between the back and loop member, clip means connected to said loop member at its outer side and including a downturned flexible part for engaging a belt, pocket or similar object to support said article carrier when no belt extends through said loop member defining passage, said clip means including an inverted U-shaped holder having a pair of depending leg parts connected by a web part, a cover having a horizontal slot therein, means connecting said cover at its margins to the outer side of said loop member, said cover and loop member forming an envelope, said cover slot communicating with the interior of said envelope, one of said clip means leg parts extending through said slot and into the interior of said envelope, theother clip means leg part extending downwardly over said cover for engaging said belt, pocket or similar object, means associated with said one leg part for securing said one leg part within said envelope interior.

* * * * *